US008943731B2

(12) United States Patent
Niebling

(10) Patent No.: US 8,943,731 B2
(45) Date of Patent: Feb. 3, 2015

(54) DEVICE FOR CLEANING THE INSIDE OF THE BARREL OF A FIREARM

(75) Inventor: Hans Niebling, Ansbach (DE)

(73) Assignee: Niebling Technische Bursten GmbH, Burgbernheim (DE)

( * ) Notice: Subject to any disclaimer, the term of this patent is extended or adjusted under 35 U.S.C. 154(b) by 102 days.

(21) Appl. No.: 13/501,563

(22) PCT Filed: Oct. 14, 2010

(86) PCT No.: PCT/EP2010/006276

§ 371 (c)(1),
(2), (4) Date: Apr. 12, 2012

(87) PCT Pub. No.: WO2011/047800

PCT Pub. Date: Apr. 28, 2011

(65) Prior Publication Data

US 2012/0198747 A1 Aug. 9, 2012

(30) Foreign Application Priority Data

Oct. 21, 2009 (DE) ..... 20 2009 014 279 U

(51) Int. Cl.
*F41A 31/00* (2006.01)
*F41A 29/02* (2006.01)

(52) U.S. Cl.
CPC ..... *F41A 29/02* (2013.01)
USPC ..... 42/95; 15/104.16; 15/104.165; 15/104.05

(58) Field of Classification Search
USPC ..... 42/95; 15/104.05–104.33
See application file for complete search history.

(56) References Cited

U.S. PATENT DOCUMENTS

| | | | | | |
|---|---|---|---|---|---|
| 464,843 | A | * | 12/1891 | Bagger | 401/9 |
| 1,745,575 | A | * | 2/1930 | Hooker | 15/104.165 |
| 2,367,900 | A | | 1/1945 | Stine | |
| 2,559,376 | A | | 7/1951 | Schnitger | |
| 2,601,691 | A | | 7/1952 | Dyer | |
| 2,805,434 | A | * | 9/1957 | Hopkins | 15/104.16 |
| 3,064,294 | A | | 11/1962 | Stocking | |

(Continued)

FOREIGN PATENT DOCUMENTS

| | | | |
|---|---|---|---|
| DE | 1111989 | B | 7/1961 |
| DE | 3228986 | A1 | 2/1984 |

(Continued)

*Primary Examiner* — Michelle R Clement
(74) *Attorney, Agent, or Firm* — Frank H. Foster; Kremblas & Foster

(57) ABSTRACT

The device according to the invention for cleaning the inside of the barrel of a firearm consists of a pulling element (A) and a cleaning element (B) connected thereto. In this case, the cleaning element (B) has a first wetting and cleaning unit (BI), particularly for precleaning the barrel, a wiping unit (B2) and a second wetting and cleaning unit (B3), particularly for preserving the barrel. The device according to the invention has many advantages. The advantageous construction of the device means that only little expenditure of force is required during use, and so it can be pulled through the barrel of a firearm quickly in one go without stopping to put it down. The arrangement according to the invention, comprising a first wetting and cleaning unit, particularly for precleaning purposes, and a second wetting and cleaning unit, particularly for preserving purposes, with a wiping unit arranged in between, allows effective, and especially benign, cleaning of a barrel to be achieved even without the use of brushes.

8 Claims, 1 Drawing Sheet

(56) References Cited

U.S. PATENT DOCUMENTS

| | | | | |
|---|---|---|---|---|
| 4,503,578 | A * | 3/1985 | McIntyre | 15/104.165 |
| 5,245,777 | A * | 9/1993 | Neuman et al. | 42/95 |
| 5,317,827 | A * | 6/1994 | Jaremco | 42/95 |
| 5,777,258 | A * | 7/1998 | Soon | 102/442 |
| 5,972,125 | A | 10/1999 | Hedge | |
| 6,088,866 | A * | 7/2000 | Hedge | 15/104.16 |
| 6,630,034 | B1 | 10/2003 | Schnell | |
| 6,668,480 | B1 * | 12/2003 | Riley | 42/95 |
| 6,701,658 | B1 | 3/2004 | Brownell | |
| 7,356,961 | B2 * | 4/2008 | Williams | 42/95 |
| 7,676,878 | B2 * | 3/2010 | Parker-Smith | 15/104.05 |
| 8,371,057 | B2 * | 2/2013 | Coffield, III | 42/95 |
| D684,660 | S * | 6/2013 | Rogers et al. | D22/199 |
| 2006/0162223 | A1 | 7/2006 | Whipple | |
| 2007/0294930 | A1 * | 12/2007 | Mays | 42/95 |
| 2013/0091753 | A1 * | 4/2013 | Rogers et al. | 42/95 |

FOREIGN PATENT DOCUMENTS

| | | |
|---|---|---|
| DE | 4024541 A1 | 2/1992 |
| EP | 0981409 A2 | 3/2000 |
| EP | 0981409 B1 | 2/2003 |
| WO | 9813150 | 4/1998 |

* cited by examiner

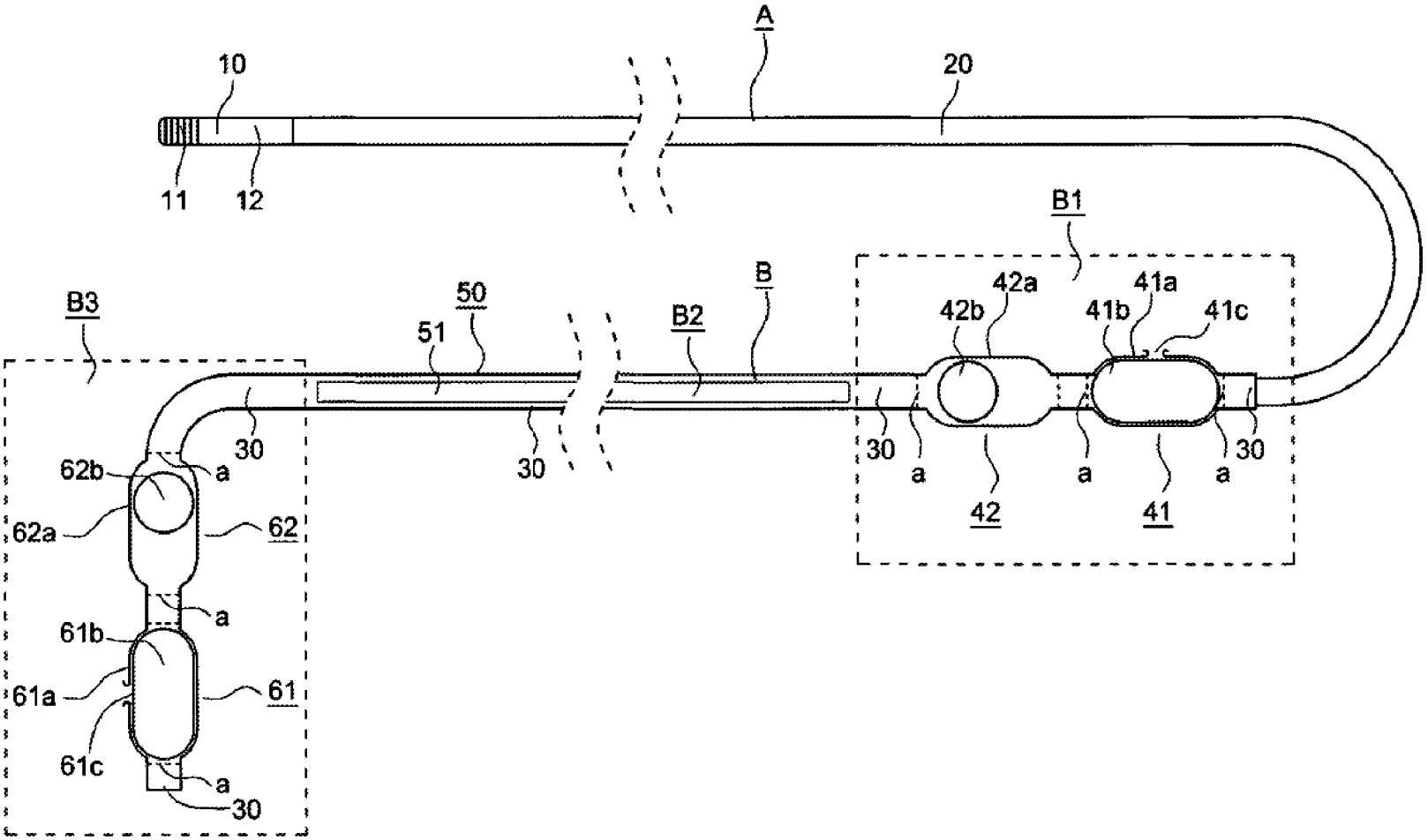
A
20
10
11
12
B1
41
41a
41b
41c
42
42a
42b
30
a
B
B2
50
51
B3
61
61a
61b
61c
62
62a
62b

DEVICE FOR CLEANING THE INSIDE OF THE BARREL OF A FIREARM

BACKGROUND OF THE INVENTION

The invention relates to a device for cleaning the inside of the barrel of a firearm, particularly of a rifle.

Devices of this type are needed, as is known, on the one hand, to remove residues from the barrel, which are deposited during the use of the firearm on the inside of the barrel. On the other hand, said devices are also needed particularly to preserve the inside of a barrel, and thus, for example, to prevent the occurrence of corrosion when a firearm is not used for a longer time.

A rifle barrel cleaning device of this type is known, for example, from EP 0 981 409 B1. Said device is used to clean the inside of a tube by carrying out more than one cleaning step, when the rifle barrel cleaning device is pulled through the tube. For this purpose, the device comprises a flexible, elongate, high tensile strength element, an elongate brush having a first end which is connected to the flexible, elongate, high tensile strength element, and a flexible, elongate cleaning section which is connected to a second end of the elongate brush.

In said rifle barrel cleaning device, particularly in the case of frequent use, the problem may arise that the inside of the barrel, and particularly the rifling located therein, are damaged due to the action of the elongate brush. Moreover, a high expenditure of force and an increased time requirement are needed to use said device, due to the high friction effect of the elongate brush on the inside of the barrel. In addition, it has been found that, in particular smaller and less strong persons frequently briefly have to interrupt the pulling-through process, possibly adapt the gripping position of a pulling hand, and subsequently continue the pulling-through process.

SUMMARY OF THE INVENTION

The invention is based on the problem of indicating a cleaning device by means of which the above-described problems can be avoided.

The problem is solved with the device indicated in Claim 1. Advantageous additional embodiments are indicated in the dependent claims.

The device according to the invention for cleaning the inside of the barrel of a firearm consists of a pulling element and of a cleaning element connected thereto. Here, the cleaning element comprises a first wetting and cleaning unit, particularly for precleaning the barrel, a wiping unit, and a second wetting and cleaning unit, particularly for preserving the barrel.

The device according to the invention has many advantages. The advantageous construction of the device means that only little expenditure of force is required during use, so that the device can be pulled through the barrel of a firearm quickly in one go without stopping to put it down. The arrangement according to the invention, comprising a first wetting and cleaning unit, particularly for precleaning purposes, and a second wetting and cleaning unit, particularly for preserving purposes, with a wiping unit arranged in between, allows effective, and especially benign, cleaning of a barrel to be achieved even without the use of brushes.

The fact that the device can be manufactured without major effort in a cost effective manner can be considered an additional advantage. Thus, particularly the first and the second wetting and cleaning units can be designed identically. In a modular construction of the cleaning device according to the invention, said units can then be connected in each case in the desired order to other elements, for example, permanently by sewing.

It is particularly advantageous to design the cleaning element of the device according to the invention in the form of a preferably knitted or circular knitted garter.

Such a garter can be filled, for example, in the area of the wiping unit, approximately in the middle of the device, with at least one additional, supporting core made of a resilient material, for example, a foam. Such a core then has a stabilizing effect on the garter, and it allows an easier handling of the device. Depending on the design, such a foam core, for example, in the form of roll material, can already be included by knitting during the manufacture of the garter. On the other hand, said foam core can also be inserted subsequently, preferably in the form of individual segments, inside the garter.

The design of the device according to the invention in the form of a garter also offers advantages in the design of the wetting and cleaning units. Thus, wetting and cleaning units thereof can be designed advantageously in the form of tubular pockets incorporated in the garter, for example, by means of side darts. Pockets of this type can then be filled, for example, for the formation of a friction element in a cleaning unit, with a filling material made of a viscoplastic material, for example, with a rubber bullet. Moreover, for the formation of a wetting element, pockets of this type can also be filled, for example, with an absorbent material. Here, one can introduce, as filling materials, various open elements, for example, a sponge, a small cloth, etc. Depending on the intensity of a previous soaking, the respective desired cleaning effect of the device according to the invention can be adjusted beforehand in this manner.

Depending on the respective existing or expected cleaning specifications, the first and second wetting and cleaning units can be designed to have different sizes. Thus, in many cases it should already be sufficient if the two wetting and cleaning units each contain a pair of a wetting element and a friction element. In a first embodiment, it is advantageous if, in the first wetting and cleaning unit, the wetting element is arranged first, in the pulling direction, and then the cleaning element, while in the second wetting and cleaning unit, the friction element is arranged first, in the pulling direction, and then the wetting element. For the adaptation, for example, to special cleaning specifications, it is also possible to switch the order of the elements in one wetting and cleaning unit or in both.

Moreover, it is possible to provide the wetting and cleaning units with more than one wetting or cleaning element. Thus, for example, it is possible, for the cleaning of barrels which, as experience has shown, are exposed to particularly strong soiling, to provide the first wetting and cleaning unit in the device according to the invention with one or more wetting elements or additional friction elements.

In a preferred embodiment of the invention, as filling material, a pressure-actuated fluid reservoir is inserted in the tubular pocket of a wetting element. Depending on the intensity of a pressure application during a use of the device according to the invention, the respective desired cleaning effect can be adjusted thereby. In a particularly advantageous embodiment, a closed fluid storing device is provided as a fluid reservoir, for example, a cylindrically extended hollow part, a pill, a small bottle or flask, having a valve-like, automatically reclosing outlet opening. Using said storing device, the fluid quantity which is to exit at the time of each use of the device according to the invention can be dosed consistently.

In the process, the wetting element can be filled with soiling dissolving reagents in the first wetting and cleaning unit, which is used particularly for precleaning the barrel, while the wetting element in the second wetting and cleaning unit, which is used particularly for preserving the barrel, can be filled with relubrication reagents.

BRIEF DESCRIPTION OF THE DRAWING

The FIGURE is a schematic view of the preferred embodiment of the invention.

DETAILED DESCRIPTION OF THE INVENTION

An embodiment example of the invention, and the advantages associated therewith are explained in greater detail below in reference to the FIGURE.

The FIGURE shows, as main components, a pulling element A and a cleaning element B connected thereto. In the embodiment example of the FIGURE, the cleaning element B contains three components, in particular a first wetting and cleaning unit B1 which is used particularly for precleaning the barrel. This is then followed by a wiping unit B2 which holds the soiling substances dissolved by the first wetting and cleaning unit B1. At the end of the device, finally, a second wetting and cleaning unit B3 is arranged, which is used particularly for preserving the barrel, and which can be designed so it has the same construction as the first wetting and cleaning unit B1.

In the embodiment shown in the FIGURE, the pulling element A comprises a head piece 10 with a stuffing sleeve 11 and a coupling 12 for the attachment of a handle. Here, the stuffing sleeve 11 is preferably made of metal, to facilitate the introduction into a barrel. The following pulling band 20 is preferably made of a tear-resistant cable that is as nonresilient as possible.

The dimensions of both the pulling element A and also of the cleaning element B are only provided as examples in the FIGURE. The length of the wiping unit B2 between the units B1 and B3 in particular can vary depending on the dimensions of a rifle barrel. If required, the arrangement can also be supplemented by further units of the present brushless type.

The entire cleaning element B is designed particularly advantageously in the form of a preferably circular knitted garter 30. The individual areas of the cleaning element B are advantageously separated by junctions a, which can be designed preferably as darts, but also as coupling pieces. In the area of the wiping unit B2, the garter 30 is designed with the aid of an additional supporting core 51, which is located inside, and preferably made of a resilient material, as a stretched wiping sock 50.

In the example represented in the FIGURE, the first and second wetting and cleaning units B1 and B3 preferably have an identical construction, and they each comprise a mutually successive pair consisting of a wetting element 41 or 61, and a friction element 42 or 62. It is particularly advantageous if the wetting and friction elements 41 or 61, and 42 or 62, are designed in the form of tubular pockets 41*a* or 61*a*, and 42*a* or 62*a*, in the garter 30. Here, a filling material 41*b* or 61*b* made of a sponge-like, absorbent material for a fluid reservoir is inserted in each case in the pockets 41*a* or 61*a* of the wetting elements 41 or 61. To make it possible to soak the filling materials 41*b* or 61*b*, the pockets 41*a* or 61*a* are provided with access openings 41*c* or 61*c*, in the garter.

As already explained above, several elements may also be present for each wetting and cleaning unit. Thus, for example, the first wetting and cleaning unit may comprise, in the pulling direction after the pulling element, for example, a wetting element, a friction element, and before the transition to the wiping unit, an additional wetting element.

When pulling the device through a barrel, the filling materials 41*b* or 61*b* are compressed, so that a portion of the fluid stored therein can exit through the garter 30 or through the respective access opening 41*c* or 61*c*. In another embodiment, which is not shown in the FIGURE, pressure-actuated, closed fluid storing devices, for example, small bottles, can also be introduced, instead of the filling materials 41*b* or 61*b*, which fluid storing devices comprise valve-like, automatically reclosing outlet openings for cleaning or preserving fluids.

In the example represented in the FIGURE, finally, the first and second friction elements 42 and 62, in the first and second wetting and cleaning units B1 and B3, respectively, are also identical, and designed in the form of tubular pockets 42*a* or 62*a*, in the garter 30. Filling materials 42*b* or 62*b* made of a viscoplastic material, for example, bullets made of rubber, are inserted into the pockets. Their diameters are adapted to a barrel to be cleaned, in such a manner that the surrounding garter is pressed when the device is used, with generation of a friction force, against the inside of a barrel. The cleaning effect can be further improved if the bullets, as already represented in the example of the FIGURE, are movable inside the tubular pockets.

LIST OF REFERENCE NUMERALS

A Pulling element
10 Head piece
11 Stuffing sleeve
12 Coupling for the attachment of a handle
20 Pulling band
B Cleaning element
30 Garter
a Junctions, particularly darts or coupling pieces
B1 First wetting and cleaning unit, particularly for precleaning
41 First wetting element
41*a* Tubular pocket in the garter
41*b* Filling material as fluid reservoir
41*c* Access opening in the garter
42 First friction element
42*a* Tubular pocket in the garter
42*b* Filling material, made in particular of a viscoplastic material
B2 Wiping unit
50 Wiping sock
51 Supporting core made of a resilient material
B3 Second wetting and cleaning unit, particularly for preserving
61 Second wetting element
61*a* Tubular pocket in the garter
61*b* Filling material as fluid reservoir
61*c* Access opening in the garter
62 Second friction element
62*a* Tubular pocket in the garter
62*b* Filling material, made in particular of a resilient, viscous material

The invention claimed is:

1. Device for cleaning the inside of the barrel of a firearm, particularly of a rifle, the device having a pulling element (A), and a garter forming a cleaning element (B) connected to the pulling element (A), which cleaning element is brushless and comprises in the following sequence a first wetting and cleaning unit (B1), for precleaning the barrel, a wiping unit (B2), and a second wetting and cleaning unit (B3), for preserving the barrel wherein the garter (50) of the cleaning element (B) is filled at least in the area of the wiping unit (B2) with at least one supporting core (51) made of a resilient material, wherein the first or second wetting and cleaning unit (B1, B3) has in each case at least one wetting element (41; 61) and at least one friction element (42; 62), wherein the friction element (42; 62) of the first or second wetting and cleaning unit (B1, B3) comprises a filling material (41*b*; 61*b*) made of a viscoplastic material.

2. Device according to claim 1, wherein the wetting element (41; 61) of the first or second wetting and cleaning unit (B1, B3) comprises a filling material (41*b*; 61*b*) made of a sponge-like, absorbent material.

3. Device according to claim 1, wherein the wetting element (41; 61) of the first or second wetting and cleaning unit (B1, B3) comprises a pressure-actuated dosing fluid reservoir, as filling material (41*b*; 61*b*).

4. Device according to claim 3, wherein the fluid reservoir is a closed fluid storing device with a valve-like, automatically reclosing exit opening.

5. Device according to claim 1, wherein the viscoplastic material is a rubber bullet.

6. Device according to claim 1, having tubular pockets (41*a*, 61*a*; 42*a*, 62*a*) in the garter (30) as wetting and friction elements (41, 42; 61, 62) in the first or second wetting and cleaning unit (B1, B3).

7. Device according to claim 6, wherein at least the tubular pockets (41*a*; 61*a*) of the wetting elements (41; 61) in the first or second wetting and cleaning unit (B1, B3) have an access opening (41*c*; 61*c*).

8. Device according to claim 1 wherein (a) the first wetting and cleaning unit includes a fluid reservoir containing a soiling dissolving reagent; and (b) the second wetting and cleaning unit includes a fluid reservoir containing a relubrication reagent.

* * * * *